US009484141B2

(12) United States Patent
Stryken et al.

(10) Patent No.: US 9,484,141 B2
(45) Date of Patent: Nov. 1, 2016

(54) COMPACT TRIANGULAR CORE TRANSFORMER

(71) Applicant: ABB Schweiz AG, Baden (CH)

(72) Inventors: Egil Stryken, Drammen (NO); Pawel Klys, Lodz (PL); John Wallumrod, Hof (NO); Robert Platek, Krokow (PL); Tomasz Nowak, Krakow (PL); Abdolhamid Shoory, Buchs (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/425,260

(22) PCT Filed: Aug. 8, 2013

(86) PCT No.: PCT/EP2013/066618

§ 371 (c)(1),
(2) Date: Mar. 2, 2015

(87) PCT Pub. No.: WO2014/032930

PCT Pub. Date: Mar. 6, 2014

(65) Prior Publication Data

US 2015/0235752 A1 Aug. 20, 2015

(30) Foreign Application Priority Data

Aug. 29, 2012 (EP) ..... 12182169

(51) Int. Cl.

| | |
|---|---|
| ***H01F 30/12*** | (2006.01) |
| ***H01F 27/28*** | (2006.01) |
| ***H01F 27/24*** | (2006.01) |
| ***H01F 7/06*** | (2006.01) |
| ***H01F 41/02*** | (2006.01) |

(52) U.S. Cl.

CPC ..... *H01F 27/24* (2013.01); *H01F 41/02* (2013.01); *Y10T 29/49071* (2015.01)

(58) Field of Classification Search

CPC .... H01F 27/24; H01F 27/2455; H01F 27/25; H01F 41/02; H01F 3/02; H01F 3/04; Y10T 29/49071

USPC ..... 336/5, 184, 234, 216, 217; 29/605

See application file for complete search history.

(56) References Cited

U.S. PATENT DOCUMENTS

| | | | | |
|---|---|---|---|---|
| 2,359,173 A * | 9/1944 | Troy | ..... | H01F 30/12 242/434 |
| 4,588,971 A * | 5/1986 | Beisser | ..... | H01F 27/306 336/150 |
| 2010/0176906 A1* | 7/2010 | Takeuchi | ..... | H01F 27/245 336/212 |

FOREIGN PATENT DOCUMENTS

| | | |
|---|---|---|
| DE | 2024920 A1 | 12/1971 |
| EP | 2395521 A1 | 12/2011 |
| JP | 2003163124 A | 6/2003 |

OTHER PUBLICATIONS

European Search Report Application No. EP 12 18 2169 Completed: Feb. 22, 2013; Mailing Date: Mar. 1, 2013 7 pages.

International Search Report and Written Opinion of the International Searching Authority Application No. PCT/EP2013/066618 Completed: Sep. 10, 2013; Mailing Date: Sep. 18, 2013 10 pages.

* cited by examiner

*Primary Examiner* — Mangtin Lian

(74) *Attorney, Agent, or Firm* — Whitmyer IP Group LLC

(57) ABSTRACT

A three-phase stacked triangular transformer core is provided. The transformer has three legs and six yoke parts therebetween, wherein the legs include stacked laminations. In a cross-sectional plane perpendicular to a central transformer core axis, the stacked laminations are oriented in substantially radial direction, and each leg has two leg halves, wherein each leg half has a plurality of outer corners facing a corresponding leg half of a neighboring leg. For each of the leg halves the plurality of outer corners lie on a respective straight line within a lateral tolerance, and for each leg half the straight line defined by this leg half and the straight line defined by the corresponding leg half of the neighboring leg are parallel.

14 Claims, 8 Drawing Sheets

COMPACT TRIANGULAR CORE TRANSFORMER

FIELD OF THE INVENTION

Aspects of the present invention in general relate to a three-phase stacked triangular transformer core with three legs and six yoke parts, wherein said legs include stacked laminations. In particular, aspects of the present invention relate to a special arrangement and design of a stacked triangular transformer core.

BACKGROUND OF THE INVENTION

There is an ongoing trend in the reduction of total ownership cost (TOC) of transformers. This is especially of vital importance for oil-immersed distribution transformers as they constitute major part of the global power infrastructure. Due to their proximity to the customers and the importance of maintaining supply, these transformers are rarely operated under full-load conditions and hence contribution of no-load loss (or equivalently core loss) in the total transformer lifetime loss is significant. A major influence on the TOC of oil-immersed distribution transformers is the no-load or core loss. Another factor influencing the TOC is the transformer material cost. Further, compactness of the transformer is also desired.

SUMMARY OF THE INVENTION

Hence, there is a need for providing transformers for which less transformer material is needed and/or no-load or core loss is reduced, and which is compact. Some or all of these objects are achieved at least to some extent by a stacked triangular transformer core, the transformer and the method. Further aspects, advantages, and features of the present invention are apparent from the claims, the description, and the accompanying drawings.

A three-phase stacked triangular transformer core according to an aspect of the invention has three legs and six yoke parts therebetween, wherein said legs include stacked laminations. In a cross-sectional plane perpendicular to a central transformer core axis said stacked laminations are oriented in substantially radial direction. In the cross-sectional plane each leg has two leg halves, wherein each leg half has a plurality of outer corners facing a corresponding leg half of a neighboring leg. For each of the leg halves said plurality of outer corners lie on a respective straight line within a lateral tolerance $\Delta A$. Said lateral tolerance $\Delta A$ is given by $\Delta A \leq 0.02*L$, wherein L is a maximum length of a leg cross-section. For each leg half the straight line defined by this leg half and the straight line defined by the corresponding leg half of the neighboring leg are parallel.

Another aspect of the present invention is directed to a transformer comprising a transformer tank housing a transformer core as described above.

Another aspect of the present invention is directed to a method for manufacturing a stacked triangular transformer said method comprising:

a) Providing three legs including stacked laminations, wherein a cross-sectional plane each leg has two leg halves,
b) Winding of coil windings on said at least three legs;
c) Connecting said three legs with yoke parts
   whereby the legs are positioned such that in the cross-sectional plane, which is perpendicular to a central transformer core axis, for each leg said stacked laminations are oriented in substantially radial direction, and that
   each of the leg halves has a plurality of outer corners facing a corresponding leg half of a respective one of the other legs, and that for each of the halves said plurality of outer corners lie on a straight line within a lateral tolerance $\Delta A$,
   wherein for each leg half the straight line defined by this leg half and the straight line defined by the corresponding leg half of the neighboring leg are parallel, and wherein said lateral tolerance $\Delta A$ is given by $\Delta A \leq 0.02*L$, wherein L is a maximum length of a leg cross-section.

Advantageously, a portion of the circumference of each leg half—the portion facing a corresponding leg half of a neighboring leg—is approximated by a straight line. The straight lines of neighboring legs are parallel to each other and thereby channels of approximately constant width are formed between the neighbouring legs. These channels allow coils to be wound around the legs in a space-efficient manner, such that a distance between the neighboring legs can be kept small. Thereby, a compact design can be achieved and material of the yokes can be reduced. Thus, the total transformer weight can be reduced. Viewed from another angle, an advantage is that the leg cross-section can be enlarged relative to the distance between neighboring legs. Thereby core loss can be reduced.

Further, an approximately circular filled footprint realized by typical embodiments gives rise to better usage of space inside the transformer tank. In this application, the term "footprint of the core" is defined as the area which is composed of the cross-sectional areas of the transformer core in a cross-sectional plane perpendicular to the transformer core axis. The "filled footprint" is defined as the smallest convex area which encompasses the footprint.

Moreover, due the compactness of typical embodiments, less tank material is required on the one hand and a reduction of the amount of oil needed for oil-immersed distribution transformers is achieved on the other hand.

Furthermore, production processes for a typical transformer core according to the embodiments are less complex compared to production processes of wound or hybrid wound-stacked triangular cores. In particular, typical embodiments of the three-phase stacked triangular transformer core can be in principal fabricated using standard machinery. Therefore, the need for investment in core manufacturing machinery is less for typical stacked triangular transformer cores according to the embodiments than for wound and hybrid wound-stacked triangular cores.

As mentioned above, in a cross-sectional plane perpendicular to a central transformer core axis the stacked laminations are oriented in substantially radial direction. In this regard the term "stacked laminations oriented in substantially radial direction" in the present application is defined such that within a given segment of a circle at least one lamination layer is substantially oriented in radial direction (e.g. up to a deviation of 10%). All laminations may be substantially (e.g. up to a deviation of 10%) parallel.

Further, each leg cross-section has two halves wherein each half has a plurality of outer corners facing a corresponding leg half of a neighboring leg. In this regard the term "facing" is defined such that there is a direct line of sight which is unobstructed by the legs (but may be obstructed by other elements such as the coils). Thus, from each of these outer corners there is a line of view to at least some portion of the corresponding leg half of the neighboring leg which does not cross the leg in the cross-sectional plane perpendicular to the transformer core axis.

The term "outer corners" in the present application is defined as the corners which are exposed on, or protrude from, the remaining contour of the leg cross section. In other words, a region of the leg cross section around the "outer corners" is locally convex. In embodiment, the leg cross section contour has contour steps of the magnitude of more than a lamination (more than the thickness of a single lamination, i.e. disregarding any micro-steps between single laminations). Within a contour step, the laminations have substantially the same length within the cross-sectional plane. In contrast, the lamination lengths of neighboring laminations separated by a contour step are different from one another. In this embodiment, the outer corners are outer corners of a contour step. In an embodiment, a contour step includes at least five laminations.

The term "triangular" means that the three legs of the transformer core are arranged such that they form corners of a triangle in the cross-sectional plane, i.e. that they do not lie on a straight line. Preferably but not necessarily, the triangle approaches an equilateral triangle, such that none of the sides of the triangle deviates by more than 30% in length from the average triangle side length. Even more preferably the triangle is substantially equilateral (i.e. up to a tolerance of 5% in side length).

In the following, typical embodiments of a three-phase stacked triangular transformer core are described. Unless stated otherwise, each aspect or embodiment can be combined with any other aspect or embodiment described herein.

According to a typical aspect, the "plurality of outer corners" are consecutive outer corners, e.g. a group of at least three consecutive outer corners, a group of at least five consecutive outer corners, and/or a consecutive group of at least 80% of all of the outer corners of the leg half which face the corresponding leg half of the neighboring leg.

According to an embodiment, laminations of the legs are comprised of metal sheets. Said metal sheets may have any thickness, e.g. between a lower limiting value of 0.02 mm and an upper limiting value of 1 mm. Typical thickness values are between 0.20 and 0.35 mm.

According to an embodiment, the legs substantially form a rhombic or diamond-like shape. Herein, "substantially" means that all but at most four of the outer corners of the leg are arranged on a rhombus or diamond when viewed in the cross-sectional plane, up to the tolerance of $\Delta A$. Typically, opposite corners of said rhombic or diamond like shape define the longitudinal axis C of the legs and the axis M perpendicular to the longitudinal axis C, respectively.

According to a further typical embodiment of the transformer core an inner angle $\beta$ (beta) of the rhombic or diamond-like shape is about 120° ("about" means within typical tolerances such as ±5°).

According to typical embodiments, each leg is arranged such as to substantially not protrude from the straight lines of its leg halves towards the respective neighboring legs. Here, "substantially" means "by more than the tolerance of $\Delta A$". Thus, the straight lines of neighboring legs form channels between these legs.

The portion of the leg contour whose outer corners lie on the straight lines up to the tolerance of $\Delta A$ are also referred to as the flat portions of the leg contour. According to embodiments, each length of said two essentially flat portions of the outer contour of a leg cross-section is at least 25% of the total outer contour length of the leg cross-section.

According to an embodiment, the lateral tolerance $\Delta A$ is given by $\Delta A \leq 0.02*L$. Alternatively or additionally, the lateral tolerance may (also) be given by $\Delta A \leq 2$ mm.

According to an embodiment, the distance A between the parallel straight lines is given by $A \leq L$ or even by $A \leq 0.7*L$.

According to an embodiment, a leg cross-section in a plane perpendicular to the transformer core axis has an aspect ratio of a maximal width in radial direction of the legs to a maximal length in circumferential direction of the legs which is greater than 0.6 and smaller than 0.9. Typically the maximal width of the leg in radial direction is the extension of the leg in direction of a line drawn from the transformer core axis through the center of mass of the leg cross-section.

The term "in circumferential direction" in the present application is to be defined as a direction given by a tangential straight line on the circumference of a circle in the cross-sectional plane having the transformer core axis as center.

According to an embodiment, the transformer core legs each have an aspect ratio which is greater than 0.6 and smaller than 0.9.

According to an embodiment, the leg cross-section is uniform over more than 50% or even more than 75% of an axial length of the leg along the transformer axis.

According to an embodiment, the legs are symmetric (i.e. mirror symmetric) with respect to their axis in circumferential direction in a cross-sectional plane perpendicular to the transformer core axis. Typically said axis in circumferential direction is the longitudinal axis of the leg cross section. Furthermore, typically the center of mass of the leg cross-section lays on said longitudinal axis. By providing a transformer with symmetric transformer core legs the manufacturing process for the transformer is simplified.

According to another typical embodiment of the transformer core, the legs are asymmetric with respect to their longitudinal axis in circumferential direction in a cross-sectional plane perpendicular to the transformer core axis. Typically, according to the embodiments with asymmetric legs the center of mass of the leg cross-section lays not on said longitudinal axis. In particular, according to typical embodiments of the transformer core with asymmetric legs is characterized in that the center of mass of the leg cross-sections is shifted from the longitudinal leg axis towards the transformer core axis. The asymmetric shape allows adapting the transformer footprint more flexibly to respective requirements, e.g. a cylindrically shaped transformer tank.

According to an embodiment, a ratio between footprint area of the core and an area of the smallest circle encompassing the footprint is higher than 40%, higher than 55%, or even higher than 65%. Thereby, a reduction of material need as well as a reduction of the amount of oil needed for an oil-immersed distribution transformer may be achieved. In particular, the ratio between the footprint area and the area of the smallest circle encompassing the footprint is a measure for the compactness of the transformer core.

According to another embodiment of the transformer core, a ratio of the total weight of the yoke parts to the total weight of the legs is typically smaller than 65%, typically smaller than 55% or typically smaller than 45%. Similarly to the legs, the yoke parts are typically comprised of stacked laminations. Herein, the yoke parts are distinguished from the legs in that they are made of separate laminations and then joined. Additionally or alternatively, the legs (long side of the legs) are oriented parallel to the transformer axis, whereas the yoke parts (long side of the yoke parts) are oriented in a direction substantially perpendicular to this axis.

According to another typical embodiment of the transformer core an angle between the yoke parts and the corresponding legs is 90°, wherein a direction of the yoke parts and the legs for definition of said angle is given by their orientation of respective laminations. Typically said angle between the yoke parts and the corresponding legs is the angle at the outer corner or inner corner at which the yoke parts meet the corresponding legs. Accordingly, the production and assembly of a typical transformer core according to the embodiments is easier and more cost efficient than that of transformer cores known from the prior art.

According to another embodiment of the transformer core the yoke parts between two neighboring legs are bent i.e. the laminations of the yoke parts are not straight but curved. Typically the bent yoke parts are comprised of laminations, which are pre-bent or bent during the assembly of the transformer core. By employing pre-bent yoke part laminations a spring-back effect during the assembly is avoided. According to further typical embodiments of the transformer core said yoke parts are V-shaped or U-shaped. Typically said V-shaped or U-shaped yoke part laminations are produced by pressing or stamping. According to typical embodiments the yoke parts are bent towards the transformer core axis i.e. the apex of the curvature points towards the transformer core axis.

By providing curved shaped, V-shaped or U-shaped yoke parts less material is required for building the connection between neighboring core legs via the yoke parts. Accordingly, a typical transformer core according to the embodiments comprises yoke parts having less weight which leads to an overall reduction in weight of the complete transformer and to a more compact design.

According to another typical embodiment of the transformer core ends of the legs and ends of the corresponding yoke parts are cut angularly. According to typical embodiments of the transformer core an angle of an angular cut of the leg ends and yoke ends is defined as the angle with respect to the longitudinal axis of the legs and the yoke parts, respectively. Typically the angle of an angular cut at a leg end and the angle of an angular cut at a corresponding yoke part end are such that both angles add up to 90°. In detail, when the angle of an angular cut at a leg end is 45°, 50°, or 55° the angle of an angular cut at a corresponding yoke part end is 45°, 40° or 35°. According to typical embodiments of the transformer core the angle of an angular cut is about 45°. Other values are also possible.

According to another typical embodiment of the transformer core each of the yoke parts has a plurality of yoke laminations. In an embodiment, the yoke laminations are grouped into different groups of yoke laminations. The laminations within each group have a length within the cross-sectional plane which varies between two neighboring laminations by at most ΔL given below. Herein, the length difference i.e. increase or decrease in yoke lamination length ΔL between successive yoke laminations within a given core step, is given by the equation $\Delta L=\pi/3*d_s$, wherein $d_s$ is the thickness of a single lamination.

In embodiments, the yoke lamination length ΔL between successive yoke laminations within a given core step is such that the end sides of the laminations define a flat face of the core step. In embodiments, the laminations within each group have the same axial extension along the transformer axis.

According to embodiments, the end faces of the yokes are shaped complementarily to the contours of the legs with which the end faces of the yokes are in contact, respectively. Hence, the outer corners of the legs correspond to/are in contact with inner corners of the core steps of the yokes.

In typical embodiments of the transformer core low voltage windings and high voltage windings (45) are wound directly on the legs. Herein, windings being wound directly on the legs means that the windings have been wound, turn by turn, on the legs instead of having been wound previously and put onto the legs only after the winding. That the windings are wound directly on the legs does not exclude that there may be some spacers arranged between the windings and the legs. In general, the directly-wound windings have a non-circular cross-section reflecting the external shape of the leg, whereas previously-wound windings have a circular cross-section. Hence, as a general aspect, the windings have a non-circular cross section in the cross-sectional plane. Typically, said low voltage winding is directly wound onto the core legs and said high voltage winding envelopes the low voltage winding.

Another aspect of the present invention is directed to a transformer comprising a transformer tank housing a transformer core as described above. According to embodiments, in a cross-sectional plane perpendicular to the transformer core axis, the legs and windings of the transformer cover typically at least 55%, typically at least 65%, or typically at least 70% of the cross-sectional area within the transformer tank. Typically said transformer tank is cylindrical.

According to embodiments, the transformer is an oil-immersed distribution transformer comprising transformer oil in the transformer tank. According to embodiments, the transformer is adapted for a power range of up to at least 10 MVA and for a voltage range of up to at least 36 kV. According to an embodiment, at least one transformer coil is directly wound onto a corresponding one of the legs.

According to an embodiment of the method for manufacturing the stacked triangular transformer, the method further comprises placing the transformer core into a transformer tank. According to an embodiment, the method further comprises directly winding a respective coil onto each one of the legs.

BRIEF DESCRIPTION OF THE DRAWINGS

Typical embodiments are depicted in the drawings and are detailed in the description which follows. In the drawings.

DETAILED DESCRIPTION OF THE INVENTION

Reference will now be made in detail to the various embodiments of the invention, one or more examples of which are illustrated in the figures. Within the following description of the drawings, the same reference numbers refer to same components. Generally, only the differences with respect to individual embodiments are described. Each example is provided by way of explanation of the invention and is not meant as a limitation of the invention. Further, features illustrated or described as part of one embodiment can be used on or in conjunction with other embodiments to yield yet a further embodiment. It is intended that the description includes such modifications and variations.

Figure 1:
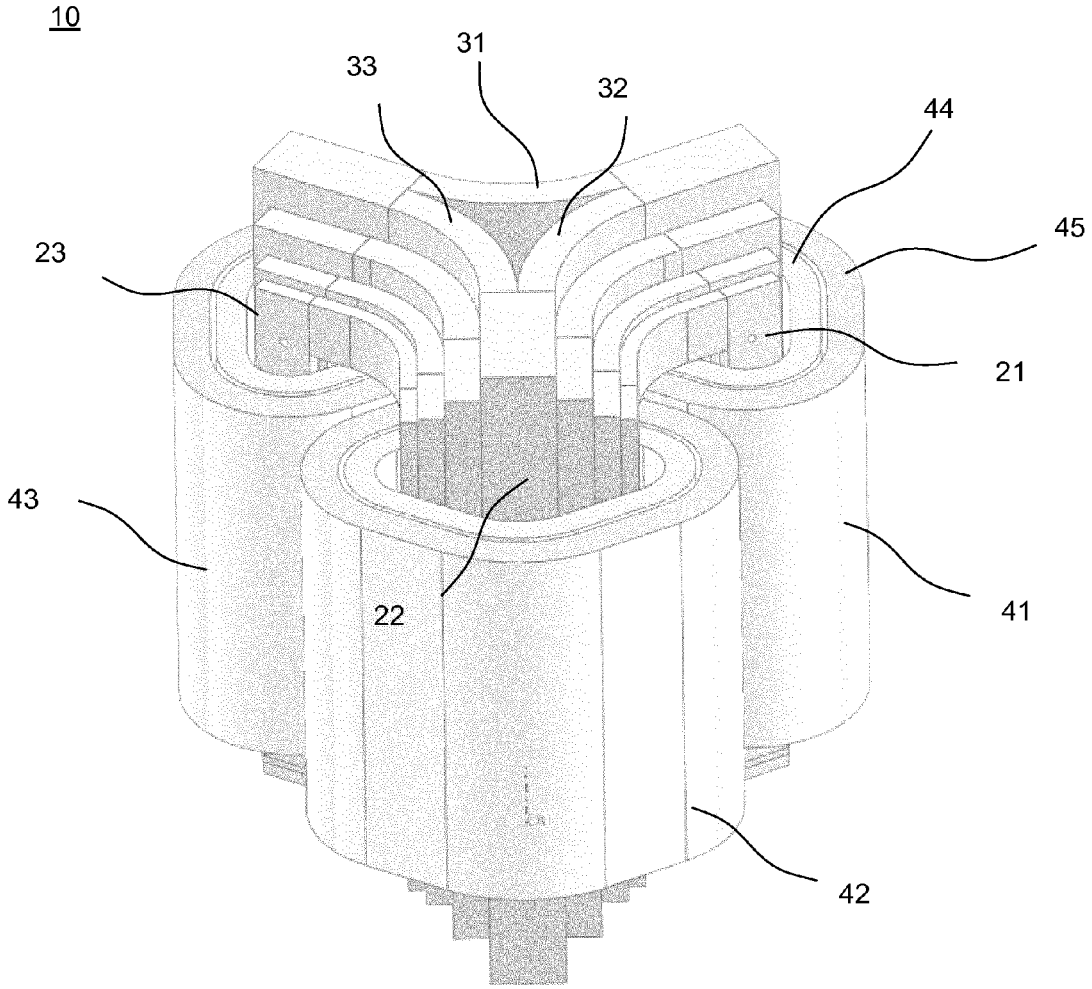
FIG. 1 illustrates a perspective view of a typical embodiment of a three-phase stacked triangular transformer core with windings.

FIG. 1 shows a perspective view of active parts of a transformer, namely of a three-phase stacked triangular transformer core 10 with windings 41, 42, 43. The transformer core according to the embodiment is comprised of three legs 21, 22, 23 and six yoke parts 31, 32, 33 connecting the ends of said legs 21, 22, 23. As shown in FIG. 1 each of said windings 41, 42, 43 is comprised of a low voltage winding 44 and a high voltage winding 45. Said low voltage 44 winding is directly wound onto the core legs 21, 22, 23 while said high voltage winding 45 envelopes the low voltage winding 44. As depicted in FIG. 1 the yoke parts 31, 32, 33 are bent. In detail according to a typical embodiment as shown in FIG. 1 said yoke parts 31, 32, 33 are curved towards the axis H of the transformer core.

Figure 2:
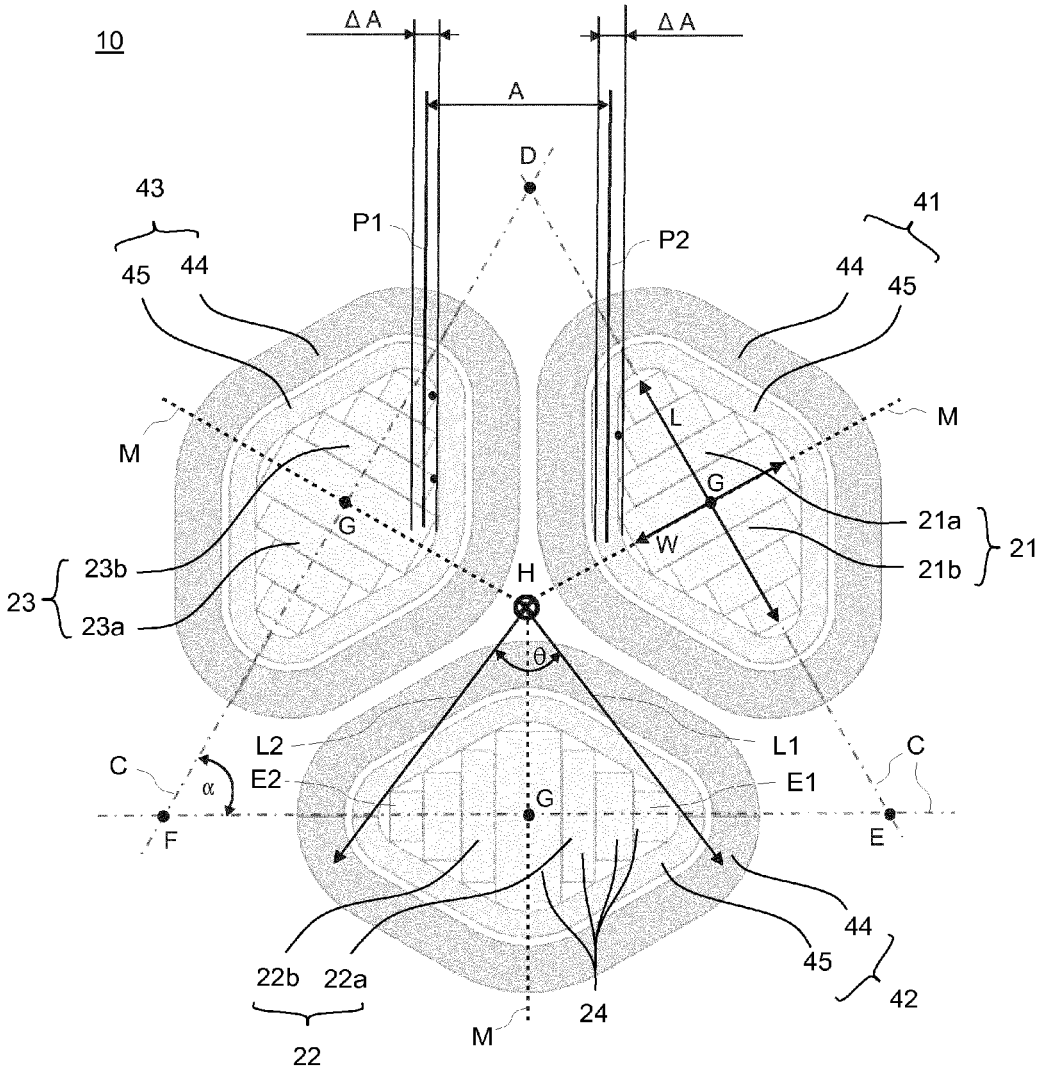
FIG. 2 illustrates a cross-section of a typical embodiment of a three-phase stacked triangular transformer core with windings.

FIG. 2 shows a cross-section in a plane perpendicular to the transformer core axis H of the three-phase stacked triangular transformer core 10 of FIG. 1. As depicted in FIG. 1 the typical triangular transformer core is comprised of three legs 21, 22, 23, in particular a first leg 21, a second leg 22, and a third leg 23. Typically said legs 21, 22, 23 are wrapped with corresponding windings 41, 42, 43. Each of said windings 41, 42, 43 is typically comprised of a low voltage winding 44 and a high voltage winding 45. Typically said low voltage 44 winding is directly wound onto the core legs 21, 22, 23 while said high voltage winding 45 envelopes the low voltage winding 44.

As illustrated in FIG. 2 according to a typical embodiment of the triangular transformer core 10 the legs 21, 22, 23 are comprised of a plurality of stacked laminations 24. Typically, said stacked laminations 24 are oriented in substantially radial direction.

In the present application the term "stacked laminations oriented in substantially radial direction" is defined such that within a given segment of a circle at least one lamination layer is oriented in radial direction. In detail, in typical embodiments of the stacked triangular transformer core said segment of a circle is bounded by a first line and a second line each starting from the central transformer core axis, wherein the first line is tangential to a first end of a leg cross-section and wherein the second line is tangential to a second end of the leg cross-section opposing said first end. For explanatory reasons of the above given definition of the term "oriented in substantially radial direction".

FIG. 2 illustrates a given segment of a circle which is bounded by a first line L1 and a second line L2 each starting from the central transformer core axis H. The first line L1 is tangential to a first leg end E1 and the second line L2 is tangential to a second leg end E2 opposing said leg first end E1. Two limiting directions of radial orientation are indicated by the arrows at the ends of the first line L1 and second line L2. Therefore, any leg cross-section comprised of stacked laminations wherein at least one lamination layer is oriented in radial direction falls within the meaning of the term "oriented in substantially radial direction" according to the definition given in the present application. In the present application "in radial direction" is defined as the direction given by a direction pointing radially outwardly from the transformer core axis H and lying within the circular segment having an angle θ (theta) bounded by the first line L1 and the second line L2 as explained above with respect to FIG. 2. Hence, any leg having stacked laminations, wherein at least one lamination layer is oriented in radial direction, wherein said radial direction lies within the circular segment having an angle θ (theta) bounded by the first line L1 and the second line L2 falls within the meaning of a leg having "stacked laminations oriented in substantially radial direction" according to the definition given in the present application.

As can be seen from FIG. 2 the radial orientation of the stacked laminations 24 within each leg 21, 22, 23 is given by the direction drawn from the transformer core axis H to the center of mass G of the leg cross-sections. The stacked laminations define contour steps of the leg's contour. Also, a contour step may be made up of several stacked laminations (not shown) having same dimensions within the cross-sectional plane. The outer corners of the leg's contour are the outer corners of the contour steps.

As further illustrated in FIG. 2, typically the cross section of a leg 21, 22, 23 is symmetric with respect to a longitudinal axis C of the leg oriented in circumferential direction. In detail, "circumferential direction" means that the orientation of said longitudinal axis is given by a tangential straight line on the circumference of a circle having the transformer core axis as a center. Typically, as depicted in FIG. 2, the center of mass G of the leg cross-section lays on said longitudinal axis C. Furthermore, as can be seen in FIG. 2, the maximum length L of the leg cross-section typically lies on said longitudinal axis C. A maximum width W of the leg cross-section is typically perpendicular to the direction of the maximum length L and lies on the center of mass G of the leg cross-section. In typical embodiments of the three-phase stacked triangular transformer core the aspect ratio of maximal width W of the legs to the maximal length L of the legs is greater than 0.6 and smaller than 0.9.

FIG. 2 furthermore shows that according to typical embodiments of the transformer core the three legs 21, 22, 23 are arranged such that three lines defined by the intersections D, E, F of corresponding longitudinal axes C of the three legs 21, 22, 23 span a triangle DEF. Typically an inner angle α (alpha) of said triangle DEF is substantially 60°.

As shown in FIG. 2 according to typical embodiments of the transformer core each leg 21, 22, 23 has two halves 21*a*, 21*b*, 22*a*, 22*b*, 23*a*, 23*b*, wherein a line M divides said legs 21, 22, 23 into the first half 21*a*, 22*a*, 23*a* and the second half 21*b*, 22*b*, 23*b* perpendicular to the orientation of maximum length L and going through the center of mass G of the cross-sectional area. Typically said halves are arranged such that a first half of a leg is adjacent to a second half of a neighboring leg. This is exemplarily shown in FIG. 2, in which the first half 21*a* of the first leg 21 is adjacent to the neighboring second half 23*b* of the third leg 23, the first half 22*a* of the second leg 22 is adjacent to the neighboring second half 21*b* of the first leg 21, and the first half 23*a* of the third leg 23 is adjacent to the neighboring second half 22*b* of the second leg 22.

Furthermore, as shown in FIG. 2 each leg half 21*a*, 21*b*, 22*a*, 22*b*, 23*a*, 23*b* has a plurality of outer corners facing a corresponding leg half 23*b*, 22*a*, 21*b*, 23*a*, 21*a* of a neighboring leg. According to typical embodiments of the transformer core as shown in FIG. 2 said plurality of outer corners lie on a straight line P1, P2 within a lateral tolerance ΔA. As depicted in FIG. 2, typically for each leg half the straight line defined by this leg half and the straight line defined by the corresponding leg half of the neighboring leg are parallel.

The configuration of a typical transformer core according to the embodiment as depicted in FIGS. 1 and 2 and exemplarily described above, has the advantage that due to the leg cross-sections and their arrangement a reduction of yoke length and hence a reduction of core footprint and weight is achieved.

Furthermore, with the embodiment of the three-phase stacked triangular transformer core as depicted in FIGS. 1 and 2 a circular footprint of the transformer is realized compared to existing triangular footprints known from the prior art. In particular, the circular footprint realized by typical embodiments of the three-phase stacked triangular transformer core gives rise to better usage of space. Furthermore, due a higher compactness of typical embodiments of the transformer core compared to the transformer cores known from the prior art has the advantage that less tank material is required and for oil-immersed transformer cores a reduction in oil is achieved.

Figure 3:
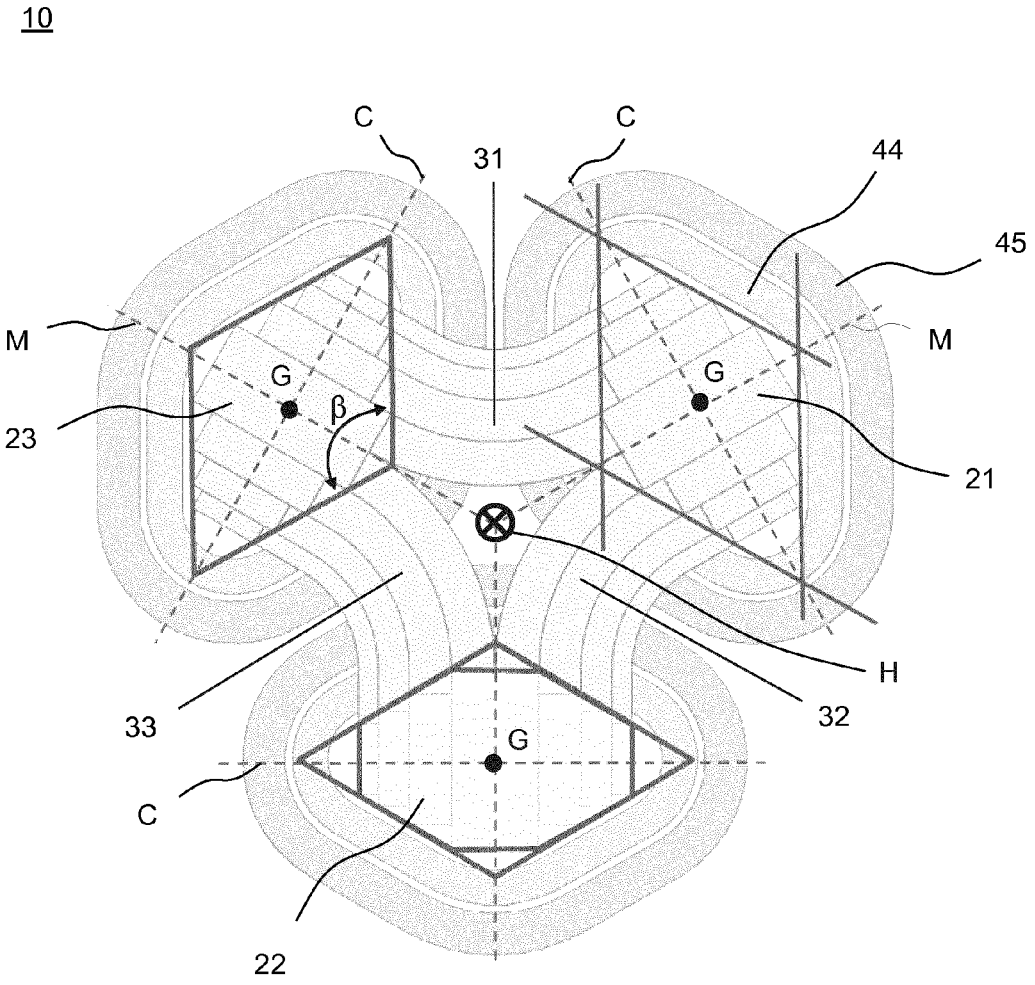
FIG. 3 illustrates a top view of a typical embodiment of a three-phase stacked triangular transformer core as depicted in FIG. 1.

FIG. 3 illustrates a top view of a typical embodiment of a three-phase stacked triangular transformer core as depicted in FIG. 1. As schematically indicated by the bold lines in FIG. 3 the stacked laminations 24 within the legs 21, 22, 23 are arranged such that they substantially form a rhombic or diamond-like shape. As depicted in FIG. 3 typically opposite corners of said rhombic or diamond like shape lie on the longitudinal axis C of the legs 21, 22, 23 and the axis M perpendicular to the longitudinal axis C, respectively. According to typical embodiments of the transformer core a radially inner angle β (beta) of the a rhombic or diamond-like shape is 120°.

Figure 4A:
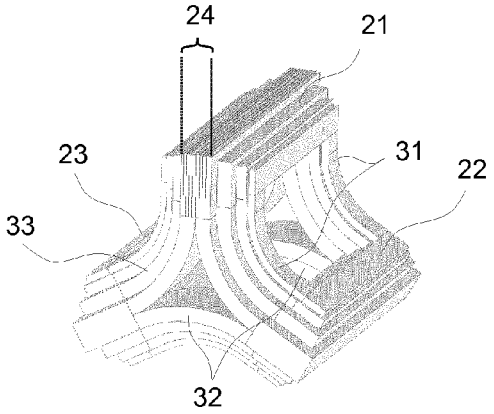
FIG. 4*a* illustrates a perspective view of a typical embodiment of a stacked triangular transformer core.

FIG. 3 further shows yokes 31, 32 and 33 which interconnect respective pairs of the legs. More precisely, yoke 31 interconnects respective leg halves of the legs 21 and 23; yoke 32 interconnects respective leg halves of the legs 21 and 22; and yoke 33 interconnects respective leg halves of the legs 22 and 23. The yokes are also shown in FIGS. 4*a*, in a perspective view. FIG. 4*a* shows that indeed a pair of yokes 31, 32 and 33 is provided which interconnect the respective pairs of the legs thereby forming a closed loop for magnetic flux between these legs.

FIG. 3 further shows that end faces of the yokes 31, 32 and 33 have contours, in the cross-sectional plane of FIG. 3, which are shaped complementarily to the contours of the legs 21, 22 and 23 with which they are in contact, respectively. Hence, the end faces of the yokes 31, 32 and 33 have a contour with core steps wherein inner corners of the core steps correspond to the outer corners of the legs.

Figure 4B:
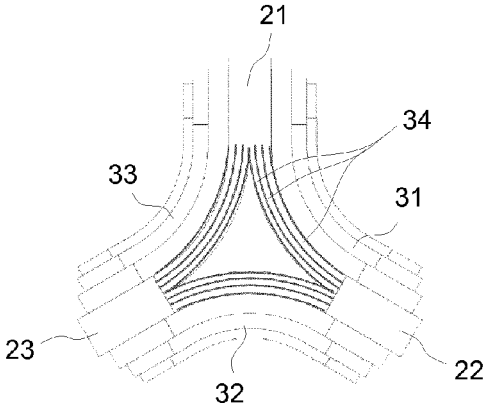
FIG. 4*b* illustrates a top view of a typical embodiment of a stacked triangular transformer core as depicted in FIG. 4*a;*

As depicted in FIG. 4*a* and FIG. 4*b*, according to typical embodiments of the transformer core the six yokes parts 31, 32, 33 as well as the three legs 21, 22, 23 are comprised of different groups of stacked laminations 34, 24. Typically the laminations 24 within a particular group of the laminations in the legs 21, 22, 23 have essentially the same dimensions and are straight in the cross-sectional plane (see FIG. 4*a*). Thereby, these laminations 24 form a straight end face of a contour step of the leg. Between different groups of the stacked laminations having different dimensions, a step is formed which defines an outer corner of the leg contour. For the yoke parts (see FIG. 4*b*), the length of the laminations within a group of stacked laminations 34 (within a step) can be non-constant and is explained in more detail with respect to FIGS. 5*a* to 5*c*.

Figure 4C:
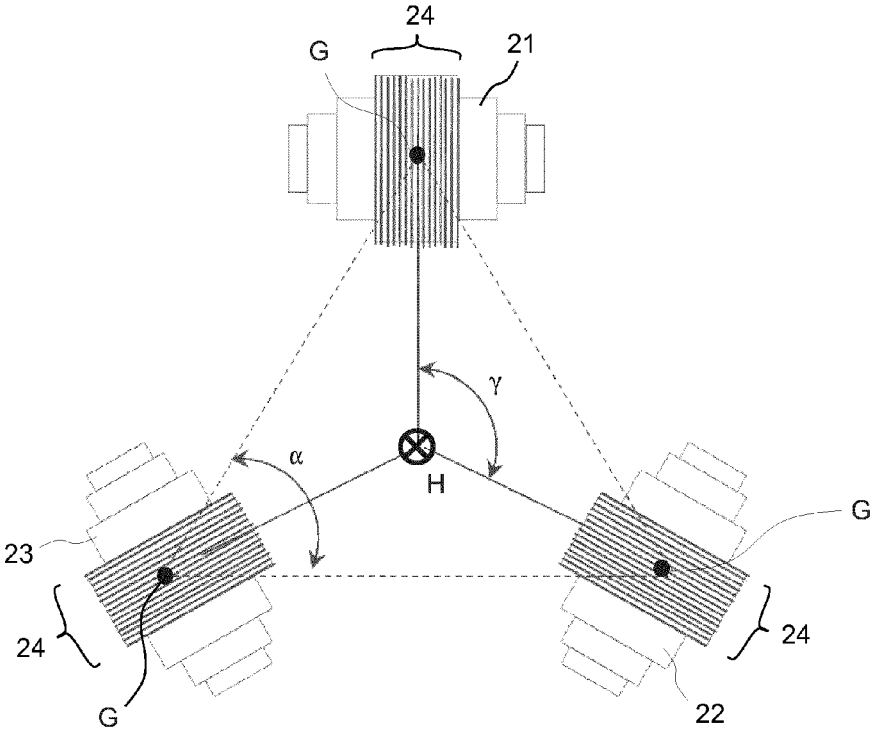
FIG. 4*c* illustrates leg cross-sections of a typical embodiment of a three-phase stacked triangular transformer as depicted in FIG. 4*a;*

FIG. 4*c* illustrates a cross-sectional view perpendicular to the transformer core axis H of the transformer core as illustrated in FIG. 4*a*. As shown in FIG. 4*c* according to typical embodiments of the transformer core, the legs 21, 22, 23 are arranged such that the geometrical centers G of the cross-sections of each leg essentially span a triangle with an inner angle α (alpha). Typically the inner angle of said triangle is 60° within a certain tolerance of +/−5°. Typically said triangle is an equilateral triangle.

Furthermore, as shown in FIG. 4*c* an angle γ (gamma) between corresponding lines drawn from the transformer core axis H to the corresponding geometrical centers G of the leg cross-sections is typically 120° within a certain tolerance of +/−5°. As shown in FIG. 4*c*, according to typical embodiments of the transformer core the direction of orientation of the lamination within the legs 21, 22, 23 essentially corresponds to the directions of the corresponding lines drawn from the transformer core axis to the center of mass of the corresponding leg. Otherwise, FIGS. 4*a* to 4*c* correspond to FIGS. 1 to 3, except that the coils are not shown. With this difference, the description of FIGS. 1 to 3 also applies to FIGS. 4*a* to 4*c*.

Figure 5A:
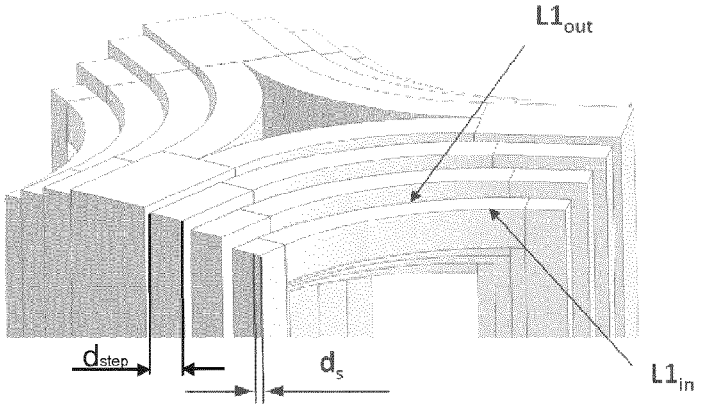
FIG. 5*a* illustrates a perspective view of an upper portion of a typical embodiment of a stacked triangular transformer core.

FIG. 5*a* illustrates a perspective view of an end portion of a typical embodiment of a stacked triangular transformer core as shown in FIG. 4*a*. Typically the curved shaped yoke parts are obtained by bending a set of stacked laminations. Typically the thickness $d_s$ of a single lamination is between 0.20 and 0.35 mm, but any other value is also possible.

As indicated by the arrows in FIG. 5*a* the yoke parts 31, 32, 33 have different outer length $L1_{out}$ and an inner length $L1_{in}$. Typically the outer length $L1_{out}$ is the length on the convex side of the curved shaped yoke part (i.e. on the radially inner side) whereas the inner length $L1_{in}$ is the length on the concave side of the curved shaped yoke part (i.e. on the radially outer side). Due to the legs being arranged and oriented triangularly, the yokes are bent by 60°, i.e. such that their opposite end faces form an angle of 60° with respect to each other. In this manner, the end faces are brought in contact with the respective contours of the legs. In particular, the end faces of the core steps described above at opposite end faces form an angle of 60° with respect to each other.

With the yokes being circularly bent, these lengths $L1_{out}$ and $L1_{in}$ are different. The difference between $L1_{out}$ and $L1_{in}$ is given in terms of the width $d_{step}$ of the step (e.g. measured along the step end face) as follows: $(L1_{out}-L1_{in})=\pi/3*d_{step}$ (=difference of circular segments of 60°=π/3 angle, the circular segments having radii differing by $d_{step}$).

In the case of the core steps comprising several laminations as shown in FIG. 4*b*, the laminations within a yoke step are, consequently, not equally long but instead differ between the outer length $L1_{out}$ and the inner length $L1_n$ (see also FIG. 4*b*). An increase of the yoke lamination length ΔL between successive yoke laminations within a given core step, is given by the equation by $\Delta L=\pi/3*d_s$, wherein $d_s$ is the thickness of a single lamination (same reasoning as above).

Figure 5B:
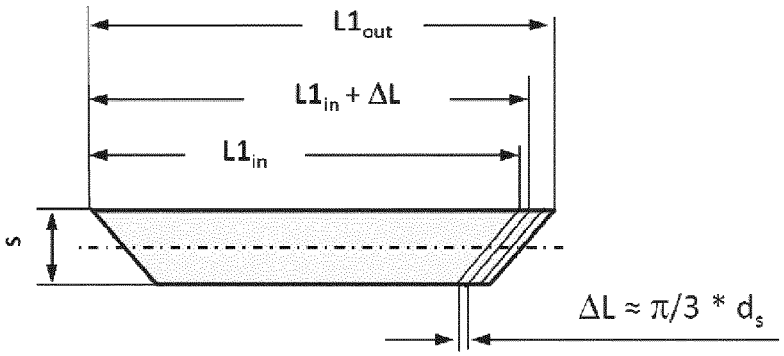
FIG. 5*b* illustrates a frontal view of a single yoke lamination before bending.

FIG. 5*b* illustrates a frontal view of yoke laminations before bending, the yoke laminations belonging to a single group (i.e. within a core step). The yokes laminations have different lengths, the lengths increasing by $\Delta L=\pi/3*d_s$ between successive yoke laminations within the core step, wherein $d_s$ is the thickness of a single lamination. After bending, the shape shown in FIGS. 4*b* and 5*a* is thus obtained.

Figure 5C:
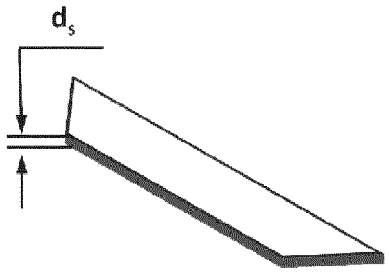
FIG. 5*c* illustrates a perspective view of a yoke lamination sheet.

As shown in FIGS. 5*b* and 5*c*, the ends of the laminations of the yoke parts can be cut angularly. Then, the ends of the legs would be also cut angularly, in order to be in contact with the yokes. Also in the embodiments shown in the other Figures, the ends of the laminations of the yoke parts and of the legs can be cut angularly, even though this may not be shown explicitly in these Figures (see e.g. FIG. 5*a*).

Figure 6A:
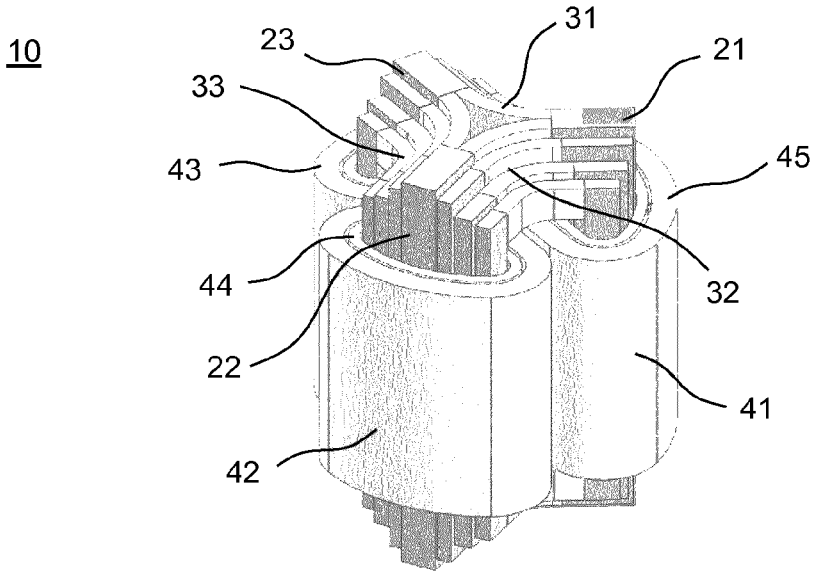
FIG. 6*a* illustrates a perspective view of another typical embodiment of a three-phase stacked triangular transformer core with windings.

FIG. 6*a* illustrates a perspective view of another embodiment of a three-phase stacked triangular transformer core with windings. In general, the description for FIG. 1 also applies to FIG. 6*a*, except with respect to special aspects of the cross-section of the transformer core described in more detail in FIG. 6*b* below.

Figure 6B:
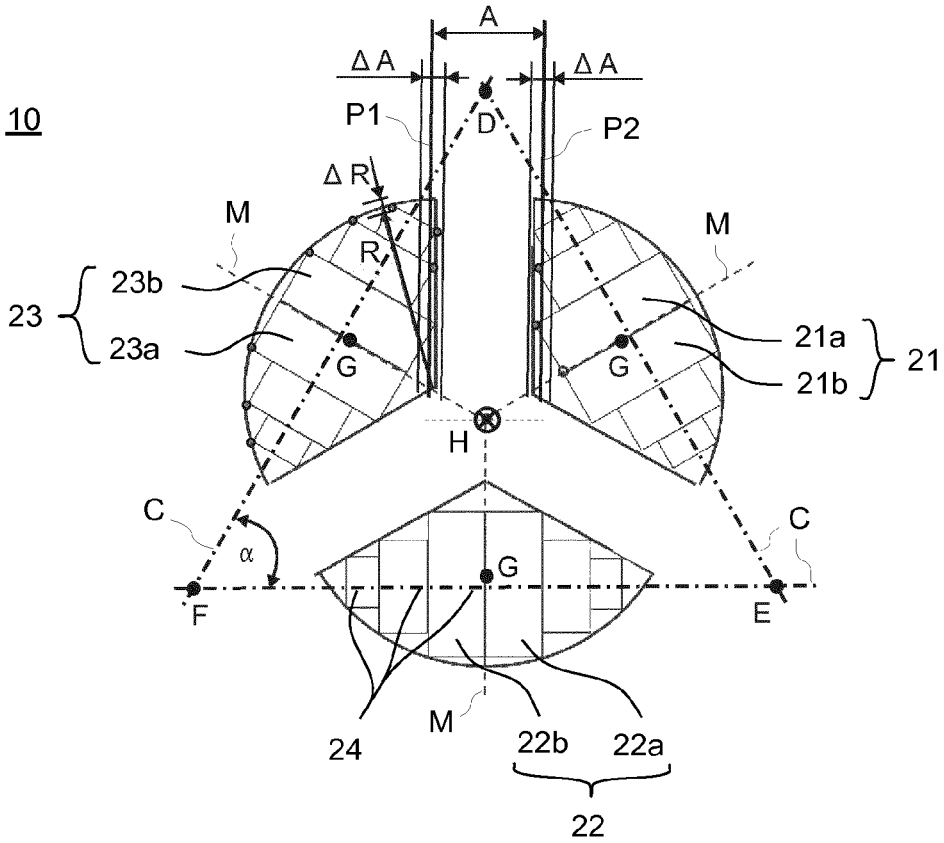
FIG. 6*b* illustrates leg cross-sections of a typical embodiment of a three-phase stacked triangular transformer as depicted in FIG. 6*a;*

FIG. 6*b* shows a leg cross-section of the transformer depicted in FIG. 6*a*. As illustrated in FIG. 6*b* according to a typical embodiment of the triangular transformer core 10 the legs 21, 22, 23 are comprised of a plurality of stacked laminations 24. Typically, said stacked laminations 24 are oriented in substantially radial direction.

According to the embodiment as illustrated in FIGS. 6*a* and 6*b*, the cross section of a leg 21, 22, 23 is asymmetric with respect to a/any longitudinal axis C oriented in circumferential direction. In detail, the orientation of said longitudinal axis is given by a tangential straight line on the circumference of a circle having the transformer core axis as a center. Typically, according to the embodiments with asymmetric legs as depicted in FIG. 6*b*, the center of mass G of the leg cross-section lays not on said longitudinal axis C. As shown in FIG. 6*b*, according to a typical embodiment of the transformer core with asymmetric legs the center of mass G of the leg cross-sections is shifted from the longitudinal axis C of said legs towards the transformer core axis.

As illustrated in FIG. 6*b*, according to typical embodiments of the transformer core with asymmetrical leg cross-sections a plurality of outer corners lying on the outer side of the transformer core substantially lie on an arc of a circle with a radius R within a radial tolerance of ΔR. Hence, According to the embodiment as depicted in FIG. 6*b* the leg cross-section is pie-shaped.

The configuration of a typical transformer core with asymmetric leg cross-sections, as exemplarily described above, has the advantage that due to the leg cross-sections and their arrangement a reduction of yoke length and hence a reduction of core footprint and weight is achieved.

Furthermore, with the embodiment of the three-phase stacked triangular transformer core as depicted in FIG. 2 a circular footprint of the transformer is realized compared to existing triangular footprints known from the prior art. In particular, the circular footprint realized by typical embodiments of the three-phase stacked triangular transformer core gives rise to better usage of space. Furthermore, due a higher compactness of typical embodiments of the transformer core compared to the transformer cores known from the prior art has the advantage that less tank material is required and for oil-immersed transformer cores a reduction in oil is achieved.

Figure 7A:
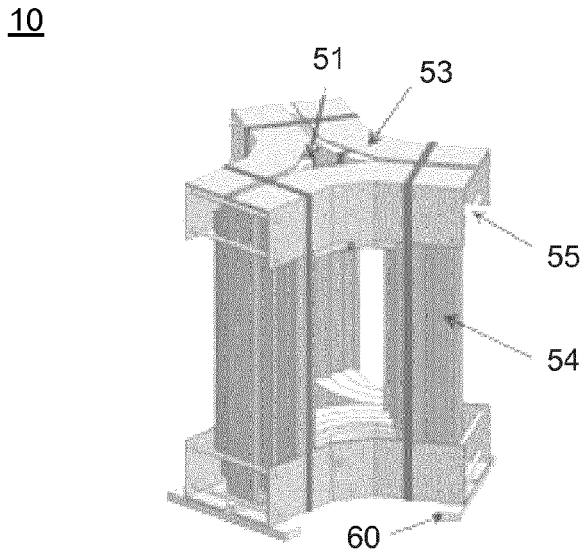
FIG. 7*a* illustrates a perspective view of a mechanical support structure of a typical stacked triangular transformer core.
Figure 7B:
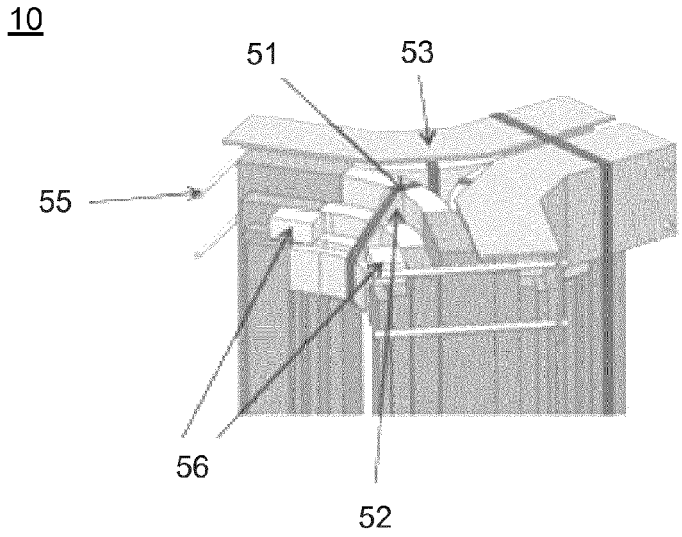
FIG. 7*b* illustrates a detailed perspective view of a mechanical support structure of a typical stacked triangular transformer core.

As illustrated in FIGS. 7*a* and 7*b*, typical embodiments of the stacked triangular transformer core comprise a mechanical support structure. As shown in FIGS. 7*a* and 7*b* a typical mechanical support structure comprises first straps 51 for clamping the yokes 31, 32, 33. Typically, for improving clamping of the yokes with said straps 51 a board frame 52 is provided. Typically said board frame 52 is adapted to the outer shape of the yoke parts 31, 32, 33.

Therefore, according to typical embodiments of the transformer core 10 comprising a typical mechanical support structure gaps between the laminations and between groups of laminations are avoided. Accordingly, by means of a mechanical support structure the performance of a transformer core according to typical embodiments is improved.

Furthermore, as shown in FIGS. 7*a* and 7*b*, the mechanical support structure typically comprises three section folded clamps 53*a*, 53*b*, 53*c*. Said folded clamps 53*a*, 53*b*, 53*c* are typically used to maintain the stability of the laminated core. According to typical embodiments, the mechanical support structure further comprises support blocks 56 mounted on the steps of the yoke parts, such that in a state when the section folded clamps 53*a*, 53*b*, 53*c* are mounted contact pressure provided by the section folded clamps 53*a*, 53*b*, 53*c* is transmitted onto the yoke parts 31, 32, 33.

Typically neighboring section-folded clamps 53*a*, 53*b*, 53*c* are connected by rods 55, which are used in order to apply a clamping force. Typically two parallel rods 55 are provided on each end of corresponding section-folded clamps.

As shown in FIGS. 7*a* and 7*b*, typically the support structure further comprises second straps 54, which are employed for maintaining the yokes at their right position with respect to the legs. Typically by said straps 54 forces parallel to the axis of the legs are applied. Thereby, typically gaps at the interface between the legs and yokes are avoided.

As depicted in FIG. 7*a*, according to typical embodiments the mechanical support structure further comprises supporting bars 60, which connect the mechanical support structure to a transformer tank 11.

As discussed earlier, according to the arrangement of the transformer core legs and yokes according typical embodiments in combination with a direct on the core winding technology gives rise to a circular footprint of the transformer core. Therefore, due to the circular footprint of the transformer core in typical embodiments the transformer core is housed within a cylindrical tank.

Figure 8:
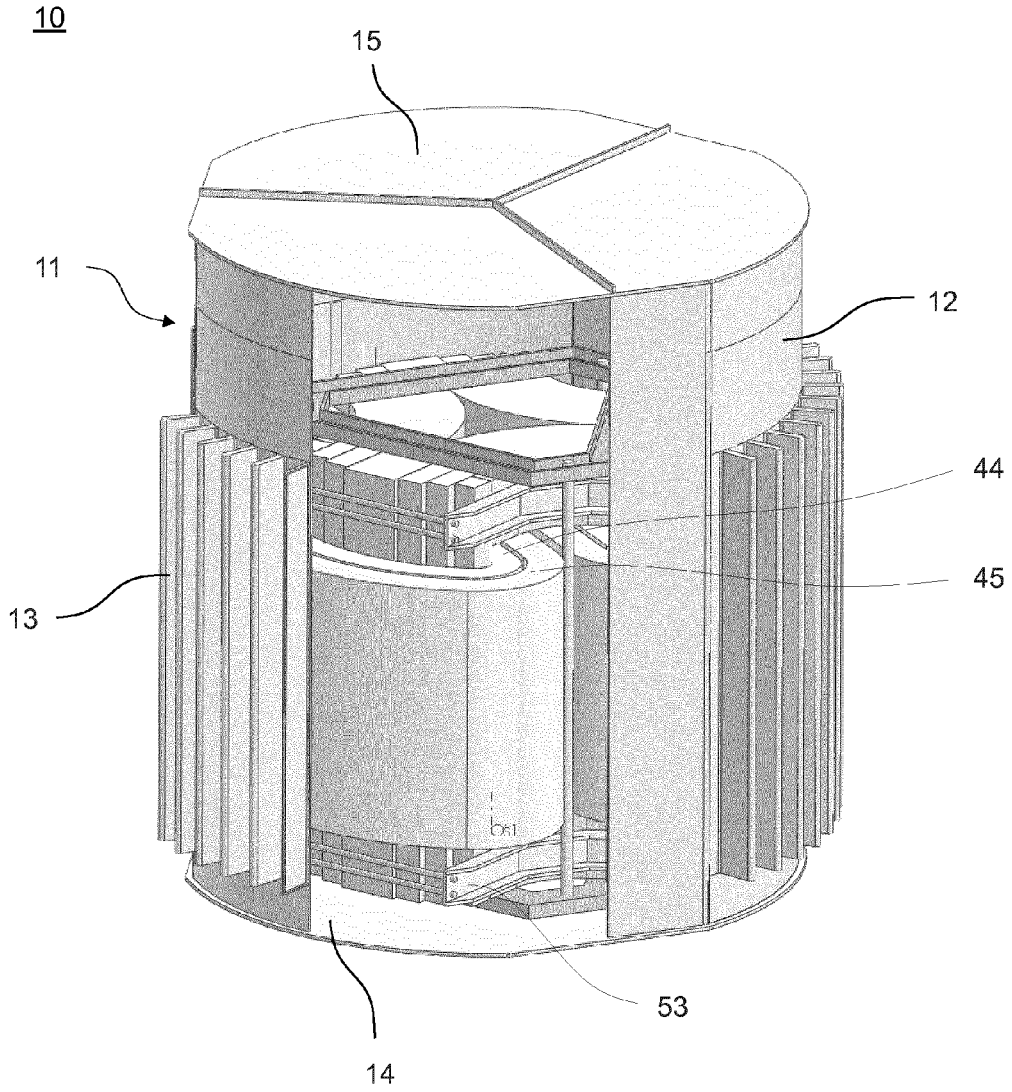
FIG. 8 illustrates a perspective view of a typical stacked triangular transformer core comprising a tank.

As shown in FIG. 8 such a circular tank 11 results in the optimal usage of the space compared to for example triangular tanks known from the prior art. Hence, with a typical transformer according the embodiments a reduction of tank material and oil usage is realized. Moreover, due to a smaller void region among the windings in typical embodiments of the stacked triangular transformer core, the amount of oil usage is further reduced compared to oil-immersed transformers known from the prior art.

According to typical embodiments of the transformer, a side wall 12 of the tank 14 comprises heat dissipative corrugations 13. Typically the corrugations are implemented in the flat plate and the two extremities of the flat plate are brought together and welded to form the side wall. The transformer bottom plate 14 is welded to the side wall 12 and is connected to the supporting bars 60 and the upper plate 15 is welded or bolted to the tank after filling the tank with oil.

The invention claimed is:

1. A three-phase stacked triangular transformer core with three legs and six yoke parts therebetween, wherein said legs include stacked laminations, characterized in that in a cross-sectional plane perpendicular to a central transformer core axis, said stacked laminations are oriented in substantially radial direction, wherein in the cross-sectional plane, each leg has two leg halves, wherein each leg half has a plurality of outer corners facing a corresponding leg half of a neighboring leg, wherein for each leg half, said plurality of outer corners lie on a respective straight line within a lateral tolerance $\Delta A$, wherein for each leg half, the straight line defined by this leg half and the straight line defined by the corresponding leg half of the neighboring leg are parallel, and wherein said lateral tolerance $\Delta A$ is given by $\Delta A \leq 0.02*L$, wherein L is a maximum length of a leg cross-section.

2. The transformer core according claim 1, wherein in the cross-sectional plane an aspect ratio of a maximal width of said legs in radial direction to a maximal length of said legs in circumferential direction is greater than 0.6 and smaller than 0.9.

3. The transformer core according to claim 1, wherein in the cross-sectional plane the legs are mirror symmetric with respect to a center line extending in circumferential direction.

4. The transformer core according to claim 1, wherein in the cross-sectional plane the legs are asymmetric with respect to any center line extending in circumferential direction.

5. The transformer core according to claim 1, wherein in the cross-sectional plane the legs are arranged such that a ratio between a footprint area of the legs and an area of a circle enveloping the legs is higher than 55%.

6. The transformer core according to claim 1, wherein a ratio of the total mass of the yoke parts to the total mass of the legs is smaller than 65%.

7. The transformer core according to claim 1, wherein an angle at an outer corner between the yoke parts and the corresponding legs is essentially 90°.

8. The transformer core according to claim 1, wherein the yoke parts are bent.

9. The transformer core according to claim 1, wherein ends of the legs and ends of the corresponding yoke parts are cut angularly.

10. The transformer core according to claim 1, wherein each of the yoke part has a plurality of yoke laminations of different length.

11. The transformer core according to claim 10, wherein an increase of the yoke lamination length between the successive yoke laminations within a given core step, is given by the equation $\Delta L = \pi/3 * d_s$, wherein $d_s$ is the thickness of a sign lamination and $\Delta L$ is a length difference in the yoke lamination length.

12. The transformer core according to claim 1, wherein low voltage windings and high voltage windings are wound directly on each of the legs.

13. Transformer having a transformer core according to claim 1.

14. A method for manufacturing a stacked triangular transformer said method comprising:

a) Providing at least three legs of stacked laminations, wherein in a cross-sectional plane, each leg has two leg halves, b) Winding coil windings on said at least three legs;

c) Connecting said at least three legs with yoke parts whereby the legs are positioned such that in the cross-sectional plane, which is perpendicular to a central transformer core axis, for each leg said stacked laminations are oriented in substantially radial direction, wherein each leg half has a plurality of outer corners facing a corresponding leg half of a neighboring one of the legs, and wherein for each leg half, said plurality of outer corners lie on a straight line within a lateral tolerance $\Delta A$, and wherein for each leg half, the straight line defined by this leg half and the straight line defined by the corresponding leg half of the neighboring one of the legs are parallel, and wherein said lateral tolerance $\Delta A$ is given by $\Delta A \leq 0.02*L$, wherein L is a maximum length of a leg cross-section.

* * * * *